US006405013B2

(12) United States Patent
Haneda et al.

(10) Patent No.: US 6,405,013 B2
(45) Date of Patent: Jun. 11, 2002

(54) FIXING APPARATUS WITH A RAY TRANSMITTING DEVICE INSIDE ONE ROLLER

(75) Inventors: Satoshi Haneda; Masahiro Onodera; Shuta Hamada, all of Hachioji (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/777,981

(22) Filed: Feb. 6, 2001

(30) Foreign Application Priority Data

Feb. 9, 2000 (JP) ..... 2000-031908

(51) Int. Cl.[7] ..... G03G 15/20
(52) U.S. Cl. ..... 399/330; 399/333; 219/216
(58) Field of Search ..... 399/328, 330, 399/333; 219/216, 469; 118/60; 432/60

(56) References Cited

U.S. PATENT DOCUMENTS 6,085,059 A * 7/2000 Haneda et al. ..... 339/333
6,282,399 B1 * 8/2001 Tokimatsu et al. ..... 399/330
6,345,169 B1 * 2/2002 Haneda et al. ..... 399/328

FOREIGN PATENT DOCUMENTS

JP 2000-3105 * 1/2000
JP 2000-305391 * 11/2000

* cited by examiner

*Primary Examiner*—Sophia S. Chen
(74) *Attorney, Agent, or Firm*—Bierman, Muserlian and Lucas

(57) ABSTRACT

The fixing apparatus fixes a toner image on a transfer material by applying heat and pressure onto the transfer material. It uses a roll-shaped rotary member for applying heat. The roll-shaped rotary member has a ray radiating device for radiating heat rays inside a cylindrical ray-transmitting base member. A cylindrical ray-transmitting elastic/insulating layer is on the base member and a heat ray absorbing layer is provided on the elastic/insulating layer. The difference between the heat ray absorbing ratio (%) per unit thickness (mm) in the base member and that in the ray-transmitting elastic/insulating layer is made not more than 20%. The fluctuations of thickness in the base member and the elastic/insulating layer are equal to, or not more than, 0.1 mm.

4 Claims, 8 Drawing Sheets

FIXING APPARATUS WITH A RAY TRANSMITTING DEVICE INSIDE ONE ROLLER

BACKGROUND OF THE INVENTION

This invention relates to a fixing apparatus for use in an image forming apparatus such as a copying machine, a printer, and a FAX machine, and in particular, to a fixing apparatus capable of making a quick start.

Heretofore, for a fixing apparatus for use in an image forming apparatus such as a copying machine, a printer, and a FAX machine, a fixing method using a heat roller has been adopted widely from low-speed machines to high-speed machines and from monochromatic machines to full-color machines as a method which has a high degree of technological completion and stability.

However, in a fixing apparatus of the conventional fixing method using a heat roller, there is a problem that, because it is necessary to heat a heat roller having a large heat capacity in heating a transfer material and toner particles, the method is not advantageous from the view point of economizing energy, and further, it takes a long time for the machine to warm up the fixing apparatus at the time of printing, which makes the printing time (warm-up time) long.

In order to solve this problem, it has been proposed and put into practice recently a fixing apparatus or an image forming apparatus using the fixing apparatus of a type of film fixing method, in which the heat roller is substituted by a heat fixing film (film for heat fixing) having an ultimately small thickness to make the heat capacity small, and the efficiency of heat transfer is raise to a large degree by bringing a temperature-controlled heater (a ceramic heater) in direct pressing contact with the heat fixing film, to make a quick start which economizes energy and requires almost no warm-up time.

Further, it has been disclosed in the publications of unexamined patent application S52-106741, S57-82240, S57-102736, S57-102741, etc., a fixing method in which no warmup time is required and a quick start is aimed at, by using a ray-transmitting base member as a modification of a heat roller for a ray fixing roller (a rotary member for applying heat) and irradiating toner particles by heat rays from a halogen lamp (ray-radiating device for radiating heat rays) provided inside to fix them by heating. Further, it has been disclosed in the publication of an unexamined patent application S59-65867, a fixing method in which a ray-absorbing layer for generating heat (heat ray absorbing layer) is provided on the outer circumferential surface of a ray-transmitting base member to make up a ray fixing roller (rotary member for applying heat), and rays from a halogen lamp (ray-radiating device for radiating heat rays) are made to be absorbed by the ray absorbing layer provided on the outer circumferential surface of the ray-transmitting base member, to fix a toner image by the heat of the ray-absorbing layer for generating heat.

In the fixing apparatus disclosed in the above-mentioned publications of the unexamined patent application S52-106741 etc., the economizing of energy and a quick start with a shortened warm-up time are aimed at by the methods in which toner particles are heated and fixed by applying heat rays from a halogen lamp (ray-radiating device for radiating heat rays) through a ray-transmitting base member, and in the fixing apparatus disclosed in the above-mentioned publication of an unexamined patent application S59-65867, by the methods in which ray absorbing layer for generating heat (heat ray absorbing layer) is provided on the outer circumferential surface of a ray-transmitting base member to make up a ray fixing roller (rotary member for applying heat), and heat rays from a halogen lamp (ray radiating device for radiating heat rays) are applied through the ray-transmitting base member, to fix toner particles by the heat of said heat ray absorbing layer; however, because the fixing ability of the above-mentioned methods is poor, the inventors of this application have proposed it in the publication of an unexamined patent application H11-327341, a fixing apparatus by which a quick start is enabled and fixing ability for a toner image is improved by providing a ray-transmitting elastic layer or a ray-transmitting heat insulating layer made of a rubber material between the ray-transmitting base member and the ray absorbing layer for generating heat (heat ray absorbing layer) to form a ray fixing roller made up of a soft roller.

However, in the fixing apparatus of the above-mentioned proposition, the ray-transmitting base member which is provided in the rotary member for applying heat and is mainly made of a glass material has a poor cylindricity and roundness, has an uneven thickness, and also has an unevenness of thickness produced in the ray-transmitting elastic layer or the ray-transmitting heat insulating layer provided on the outside (outer circumferential surface) of the ray-transmitting base member, which makes non-uniform the temperature distribution inside the rotary member for applying heat with respect to the direction along the circumferential surface and makes non-uniform the radiation quantity reaching the heat ray absorbing layer at the surface; therefore, the unevenness of heat generation in the heat ray absorbing layer at the surface is produced, and it occurs a problem that the temperature of the heat ray absorbing layer is unstable and non-uniform.

SUMMARY OF THE INVENTION

It is an object of this invention, by solving the above-mentioned problem, to provide a fixing apparatus capable of making a quick start, wherein the temperature distribution inside the rotary member for applying heat is made uniform by preventing the unevenness of heat generation in the ray-transmitting base member and ray-transmitting elastic layer or ray-transmitting heat insulating layer inside the rotary member for applying heat, and the temperature of the heat ray absorbing layer is made stable and uniform by preventing the unevenness of heat generation in the heat ray absorbing layer at the surface.

The above-mentioned object is accomplished by a fixing apparatus for fixing a toner image on a transfer material by applying heat and pressure onto said transfer material comprising a ray radiating device for radiating heat rays inside, and being provided with a cylindrical ray-transmitting base member having transmittance for said heat rays, a cylindrical ray-transmitting elastic layer or ray-transmitting heat insulating layer having transmittance for said heat rays, and a heat ray absorbing layer for absorbing said heat rays outside said ray-transmitting elastic layer or said ray-transmitting heat insulating layer to form a roll-shaped rotary member for applying heat, wherein, in the case where the fluctuation of the thickness of said ray-transmitting base member and the fluctuation of the thickness of said ray-transmitting elastic layer or said ray-transmitting heat insulating layer are both equal to or larger than 0.1 mm, the difference between the heat ray absorbing ratio (%) per unit thickness (mm) in said ray-transmitting base member as a single layer and the heat ray absorbing ratio (%) per unit thickness (mm) in said ray-transmitting elastic layer or said ray-transmitting heat insulating layer as a single layer is made equal to or less than 20%.

DETAILED DESCRIPTION OF THE PREFERRED EMBODIMENT

In the following, the embodiment of this invention will be explained. In addition, the description in this specification is not to limit the technical scope of the claims and the meaning of the terms. Further, the affirmative explanation to be described below in the embodiment of this invention is to show the best mode and not to limit the meaning of the terms and the technical scope of this invention.

Figure 1:
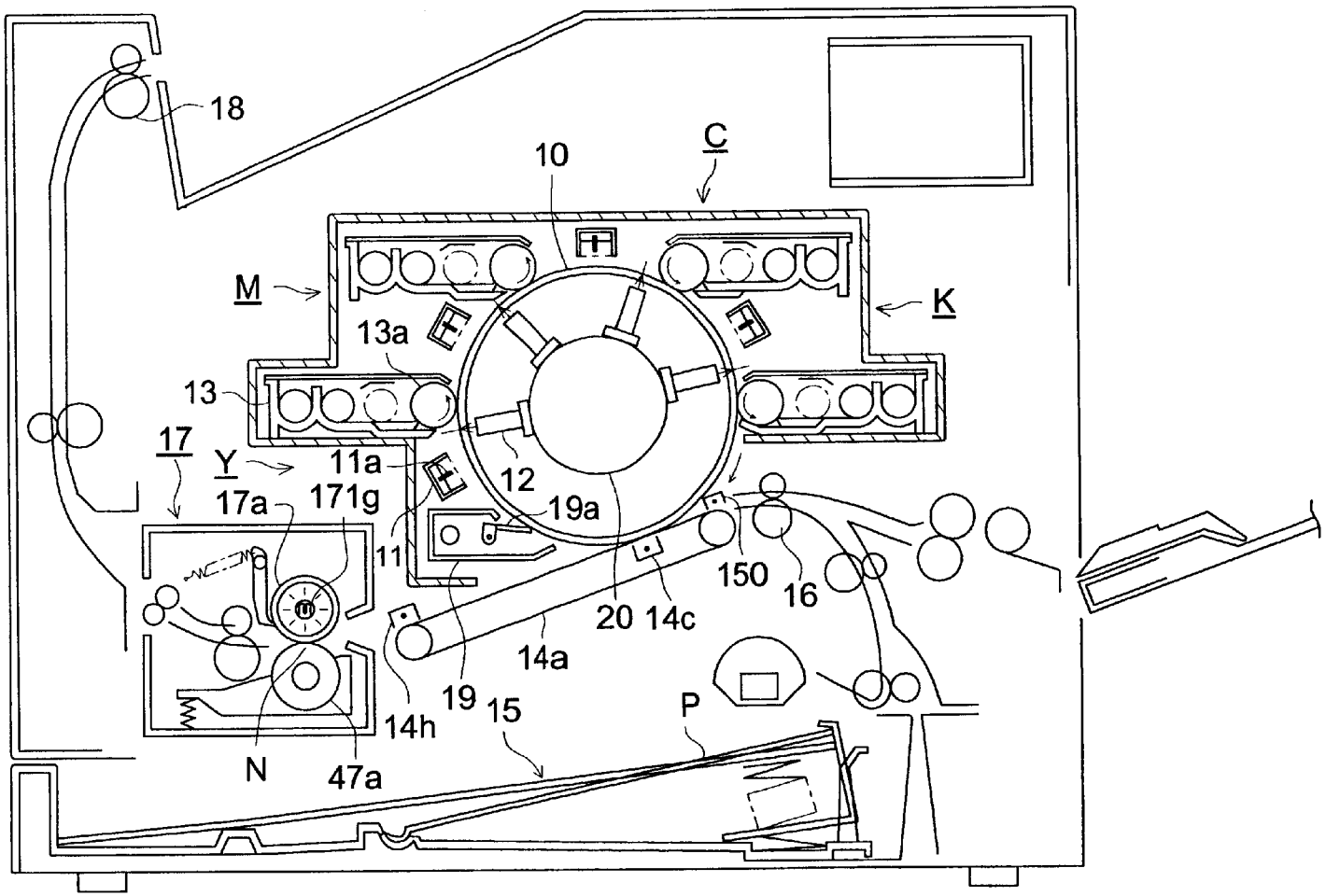
FIG. 1 is a drawing showing the cross-sectional structure of a color image forming apparatus showing an embodiment of an image forming apparatus using a fixing apparatus according to this invention.
Figure 5:
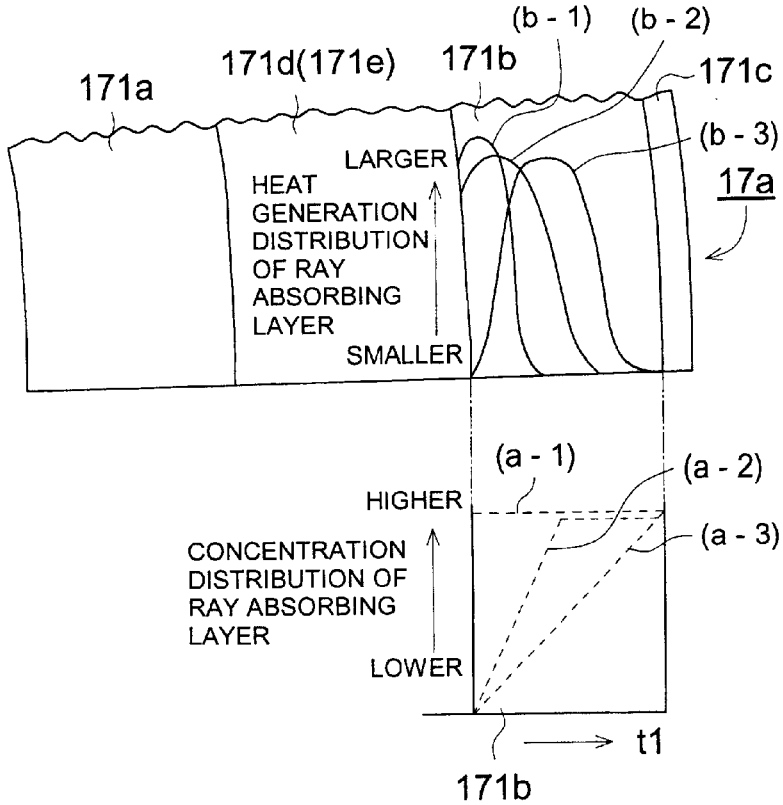
FIG. 5 is a drawing showing the concentration distribution of the ray absorbing material in the ray absorbing layer for generating heat of the roll-shaped rotary member for applying heat shown in FIG. 3.
Figure 6:
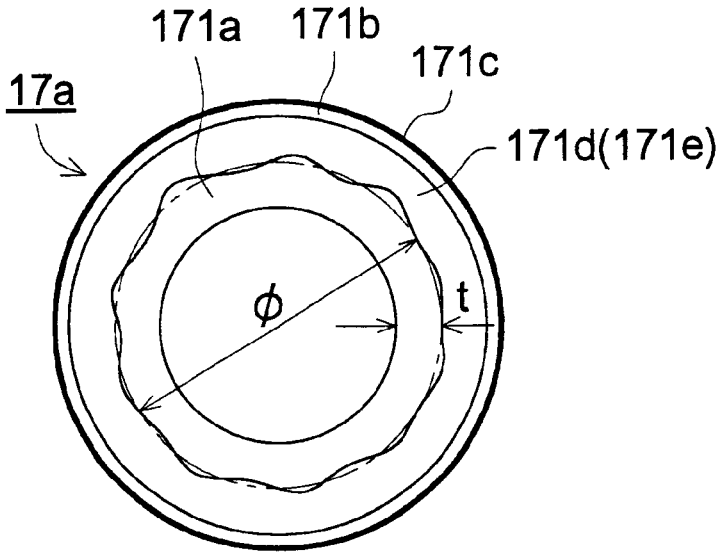
FIG. 6 is a drawing showing the outer diameter and the thickness of the ray-transmitting base member of the roll-shaped rotary member for applying heat shown in FIG. 3.

The image forming process and the mechanisms in an embodiment of the image forming apparatus using a fixing apparatus according to this invention will be explained with reference to FIG. 1 to FIG. 6. FIG. 1 is a drawing showing the cross-sectional structure of a color image forming apparatus showing an embodiment of the image forming apparatus using a fixing apparatus according to this invention, FIG. 2 is a side cross-sectional view of the image forming member shown in FIG. 1, FIG. 3 is a drawing for explaining the structure of a fixing apparatus, FIG. 4(*a*) and FIG. 4(*b*) are enlarged cross-sectional views showing the structure of the roll-shaped rotary member for applying heat shown in FIG. 3, FIG. 5 is a drawing showing the concentration distribution of the heat ray absorbing material in the heat ray absorbing layer of the roll-shaped rotary member for applying heat shown in FIG. 3, and FIG. 6 is a drawing showing the outer diameter and the thickness of the ray-transmitting base member of the roll-shaped rotary member for applying heat shown in FIG. 3.

Figure 2:
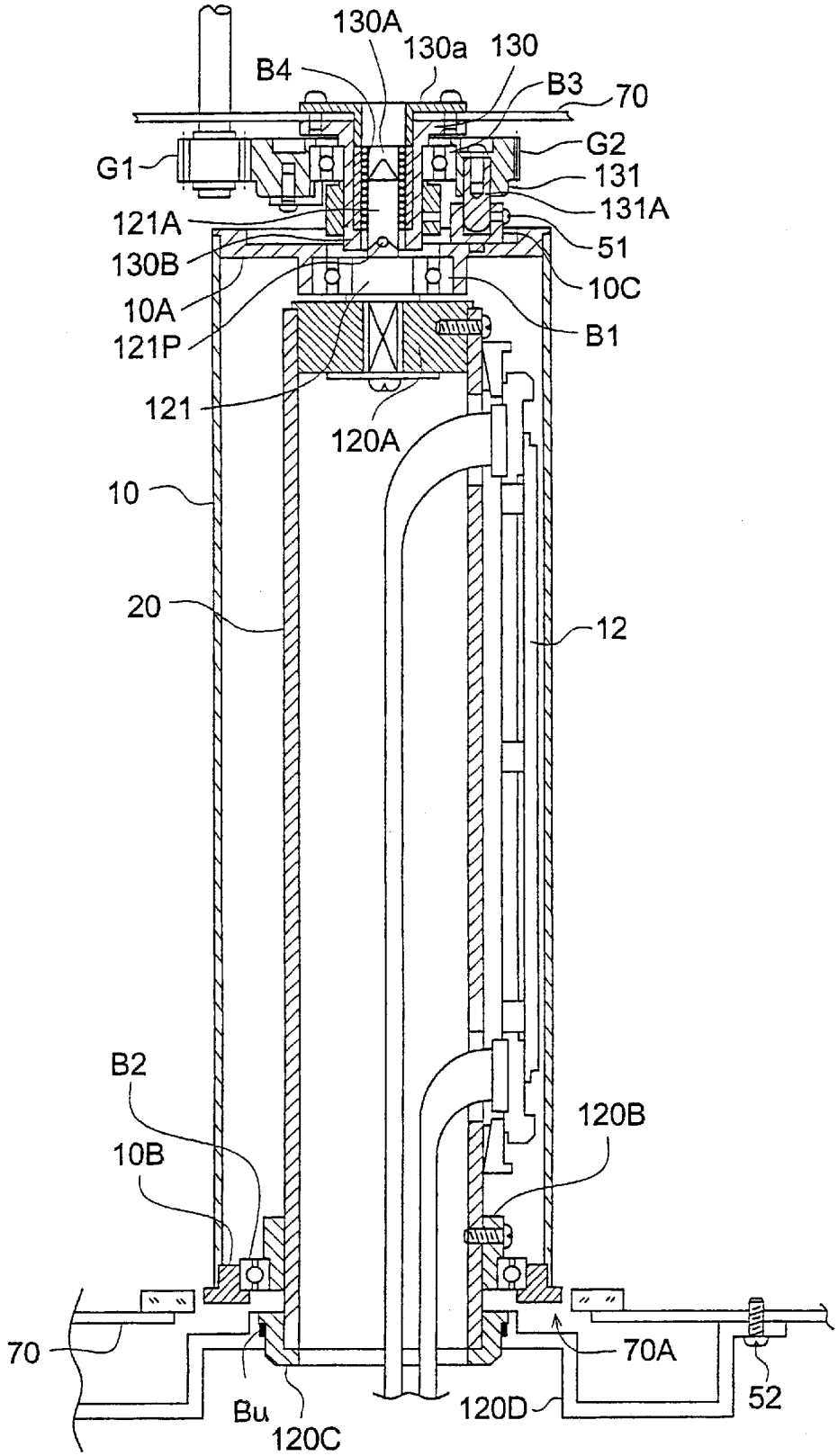
FIG. 2 is a side cross-sectional view of the image forming member in FIG. 1.
Figure 3:
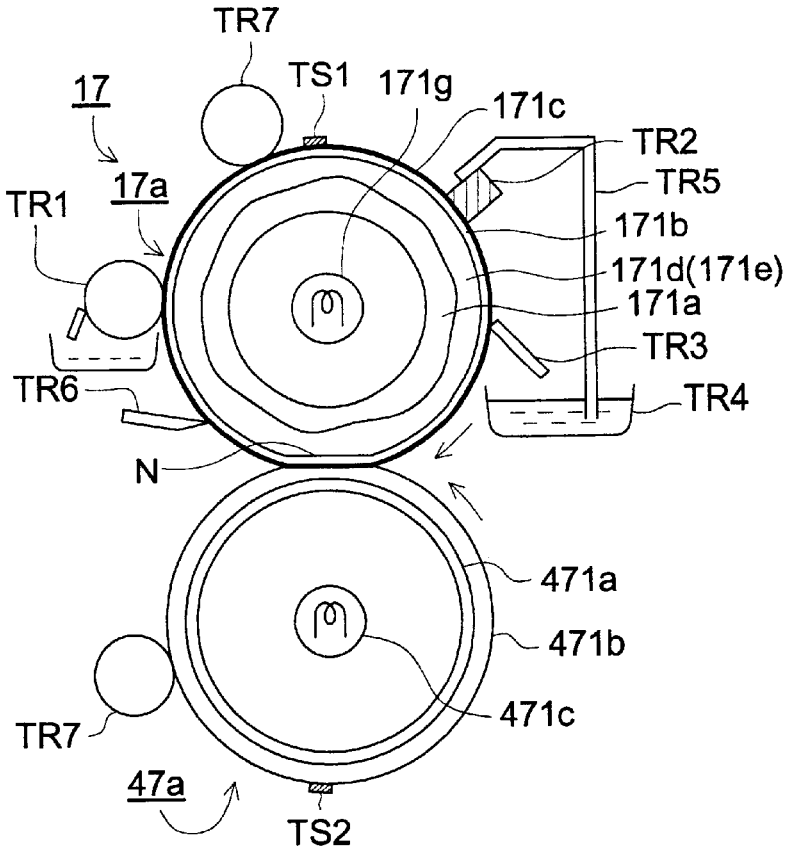
FIG. 3 is a drawing for explaining a structure of a fixing apparatus.

According to FIG. 1 or FIG. 2, the photoreceptor drum 10 denoting an image forming member has a transparent conductive layer and a photoconductive layer composed of an organic photoconductor (OPC) formed on the outer circumferential surface of a cylindrical base member, which is formed of, for example, a glass, transparent acrylic resin, or the like.

The photoreceptor drum 10 is rotated in the clockwise direction shown by the arrow mark in FIG. 1 by a driving force from a drive source not shown in the drawing, with the transparent conductive layer grounded.

In this invention, the exposure beam for image exposure is appropriate so long as it has a light quantity for exposure in the wavelength capable of giving a suitable contrast to the surface potential decrease based on the light decay characteristic of the photoconductive layer of the photoreceptor drum 10, the surface being located on the image forming plane of the exposure beam. Accordingly, the light transmittance of the transparent base member of the photoreceptor drum in this embodiment is not necessarily 100%, but it may have such a characteristic as to absorb light to some extent in transmitting the exposure beam. The essential point is that a suitable contrast can be obtained. For the material of the transparent base member, an acrylic resin, in particular, the one produced by the polymerization of monomers of methylmethacrylate ester is excellent in light transmittance, mechanical strength, dimensional precision, surface property, etc. and is desirably used; in addition to it, various kinds of transparent resins such as an acrylic resin, a fluorine-contained resin, a polyester resin, a polycarbonate resin, a polyethylene-terephthalate resin can be used. Further, the base member may be colored so long as it has a transmitting capability for the exposure light. For the material of the transparent conductive layer, indium-tin oxide (ITO), tin oxide, lead oxide, indium oxide, copper iodide, or a metallic thin film composed of Au, Ag, Ni, Al, or the like maintaining light transmitting ability can be used. For the method of forming a film, vacuum deposition, reactive vapor deposition, various kinds of sputtering methods, various kinds of CVD methods, a dip coating method, a spray coating method, etc can be utilized. Further, for the photoconductive layer, various kinds of organic photoconductor (OPC) can be used.

The organic photosensitive layer as a photosensitive layer composed of a photoconductor is a photosensitive layer composed of two layers of which the function are separated by the two layers made up of a carrier generating layer (CGL) mainly composed of a carrier generating material (CGM) and a carrier transporting layer (CTL) mainly composed of a carrier transporting material (CTM). The organic photosensitive layer composed of two layers has a high durability against abrasion as an organic photosensitive layer and is suitable for this invention because the CTL is thick. In addition, the organic photosensitive layer may be composed of a single layer in which the carrier generating material (CTM) and the carrier transporting material (CTM) are included, and in said photosensitive layer composed of a single layer or in the aforesaid photosensitive layer composed of two layers, a binder resin is usually contained.

The scorotron charger 11 as a charging means, the exposure optical system 12 as an image writing means, and the developing unit 13 as a developing means to be described below is prepared for each of the image forming processes for the colors yellow (Y), magenta (M), cyan (C), and black (K) respectively, and in this embodiment, they are arranged in the order of Y, M, C, and K with respect to the rotating direction of the photoreceptor drum 10 shown by the arrow mark in FIG. 1.

The scorotron charger 11 as a charging means is mounted close and opposite to the photoreceptor drum 10 denoting an image forming member, with its longer side arranged in the direction perpendicular to the moving direction of the photoreceptor drum 10; it carries out charging action (negative charging in this embodiment) by corona discharging of the same polarity as the toners using the control grid (no sign is attached in the drawing) which is kept in a specified electric potential with respect to the above-mentioned conductive layer of the photoreceptor drum 10 and the corona discharging electrode 11*a* made up of, for example, a sawtooth-shaped electrode, to give a uniform electric potential to the surface of the photosensitive layer. For the corona discharging electrode 11*a,* instead of the above-mentioned one, a wire electrode or a needle-shaped electrode can be used.

The exposure optical system 12 for each of the colors has a structure as an exposure unit in which a line-shaped exposure device (not shown in the drawing) having a plurality of LED's (light emitting diode) as light emitting elements for image exposure arranged in an array in the direction parallel to the axis of the photoreceptor drum 10 and the SELFOC lens (not shown in the drawing) as an image forming device having the magnification 1:1 are mounted to a holder. The exposure optical system 12 for each of the colors is mounted to the cylindrical-shaped holder 20 as a holding member for the exposure optical system, and is set inside the base member of the photoreceptor drum 10. For the exposure optical system, instead of the above-mentioned one, a line-shaped device in which a plurality of light emitting elements such as FL (fluorescent luminescence), EL (electro-luminescence), or PL (plasma discharging) elements can be used.

The exposure optical system 12 as an image writing means for each of the colors is arranged inside the photoreceptor drum 10 with its exposure position brought to a site in the upstream side of the developing unit 13 with respect to the rotating direction of the photoreceptor drum 10 between the scorotron charger 11 and the developing unit 13.

The exposure optical system 12 carries out image exposure to the uniformly charged photoreceptor drum 10 on the basis of the image data after image processing, to form a latent image on the photoreceptor drum 10. For the wavelength of the light emitting elements used in this embodiment, usually the one in the range from 680 to 900 nm for which the toners of the color Y, M, and C have a high transmittance is desirable, but a shorter wavelength than the above range for which the toners have not a sufficient transmittance is appropriate for the reason that the exposure is made from the rear side.

The developing unit 13 as a developing means for each of the colors contains inside a two-component (may be single-component) developer of the color yellow (Y), magenta (M), cyan (C), or black (K), and is provided with a developing sleeve 13*a* which is a developer carrying member having a shape of a cylinder with a thickness of 0.5 to 1 mm and an outer diameter of 15 to 25 mm formed of a non-magnetic stainless steel or an aluminum material.

In the developing region, the developing sleeve 13*a* is kept to be in non-contact with the photoreceptor drum 10 at a specified spacing, for example, 100 to 1000 $\mu$m by a rolling spacer (not shown in the drawing), and is rotated in the direction such that the direction of its peripheral movement is the same as that of the photoreceptor drum 10 at the close coming position of the both circumferences; at the time of development, by applying it to the developing sleeve 13*a,* a developing bias voltage which is a direct current voltage having the same polarity as the toners (negative polarity in this embodiment) or a direct current voltage of the same polarity with an alternate current AC voltage superposed on it, non-contact reverse development is carried out for the exposed area of the photoreceptor drum 10. It is necessary that the precision of the developing spacing expressed by the deviation of the spacing is about 20 $\mu$m or smaller.

As described in the above, the developing unit 13 reversely develops in a non-contact manner the latent image on the photoreceptor drum 10 formed by the charging by the scorotron charger 11 and the image exposure by the exposure optical system 12, with a toner having the same polarity as that of the charging of the photoreceptor drum 10 (in this embodiment, the toner has negative polarity because the photoreceptor drum is charged negatively).

As shown in FIG. 2, the photoreceptor drum 10 and the holder 20 as a holding member for the exposure optical system are both integrally made up respectively with the drum flanges 10A and 10B as supporting members for the photoreceptor drum, which support the photoreceptor drum 10 in a rotatable manner, and with the optical system flanges 120A and 120B as supporting members for the exposure optical system supporting the holder 20, by being combined by pressure fitting or through means such as screws at their respective end portions at the rear side and at the front side of the apparatus. The photoreceptor drum 10 is supported in a rotatable manner by the drum flanges 10A and 10B as supporting members for the photoreceptor drum, which are rotatable respectively around the integrally built shaft 121 of the optical system flange 120A of the holder 20 and the optical system flange 120B through the respective bearings B1 and B2.

The shaft 121 is provided with the shaft portion 121A for holding the photoreceptor drum 10, and in the base plate of the apparatus 70 at the rear side, there is provided the supporting shaft 130 as a shaft holding means having the engaging hole 130A. The linear bearing B4 is fitted into the engaging hole 130A, and the supporting shaft 130 is fixed to the rear side base plate of the apparatus 70 through the catching member 130*a* with screws or the like. The supporting shaft 130 is located at the center of the gear G2 engaging with the drive gear G1, and supports the transmission member 131, which is integrally built with the gear G2, in a rotatable manner through the bearing B3. On the other hand, in the base plate of the apparatus 70 at the front side, it is provided the opening portion 70A, which makes possible the inserting and the taking-out of the photoreceptor drum 10, which is integrally made up with the exposure optical system 12 and is fixed to the holder 20.

To the base plate of the apparatus 70 at the rear side, the holder 20 is mounted with the angular position of the exposure optical system regulated, by inserting the shaft portion 121A of the shaft 121 into the bearing B4 provided in the supporting shaft 130, and making the engaging pin 121P, which is inserted through the shaft portion 121A, engage with the V-shaped slot formed at the engaging portion 130B of the supporting shaft 130; to the base plate of the apparatus 70 at the front side, the holder 20 is mounted at a specified position by fixing the integrally formed optical system flange 120C as the supporting member for the exposure optical system at the end portion through the buffer member Bu by the front cover 120D, which is fixed with the screws 52 in the state of being pressed to the axial direction.

The coupling portion between the drum flange 10A and the gear G2 is made up of the coupling 10C attached to the side surface of the drum flange 10A as the supporting member for the photoreceptor drum for supporting the photoreceptor drum 10, the driving pin 131A attached to the side surface of the transmission member 131 which is integrally built with the gear G2, and the stopping screw 51; in the state in which the photoreceptor drum 10 integrally built with the holder 20 is mounted, the coupling 10C attached to the side surface of the drum flange 10A is fitted into the driving pin 131A attached to the side surface of the transmission member 131 having the gear G2 to make an engagement, and after that, in the state in which the transmission member 131 having the gear G2 and the photoreceptor 10 having the drum flange 10A have their centers and the outer circumferential surfaces brought into coincidence, the driving pin 131A and the coupling 10C are fixed by using the stopping screw 51 from the side direction of the photoreceptor drum 10, and the drum flange 10A and the gear G2 are combined and fixed.

With the start of the image formation, by the actuation of the motor for driving the image forming member (not shown in the drawing), the driving force for rotation of the drive gear G1 is transmitted by the gear G2 to the photoreceptor drum 10 through the coupling portion, and the photoreceptor drum is rotated in the clockwise direction shown by the arrow mark in FIG. 1, while at the same time, it is started to give an electric potential to the photoreceptor drum 10 by the charging action of the scorotron charger 11 for Y. After an electric potential is given to the photoreceptor drum 10, it is started in the exposure optical system for Y, the exposure (writing an image) based on the electrical signal corresponding to the first color signal, that is, the image data for Y, and an electrostatic latent image corresponding to the image for yellow (Y) of the original image is formed on the photosensitive layer at the surface of the photoreceptor drum 10 by the scanning made with its rotation. This latent image is reverse-developed by the developing unit 13 for Y in a non-contact manner, and a toner image of yellow (Y) is formed on the photoreceptor drum 10.

Next, the photoreceptor drum 10 is given an electrical potential on the above-mentioned toner image of yellow (Y) by the charging action of the scorotron charger 11 for M, it is carried out the exposure (writing an image) based on the electrical signal corresponding to the second color signal, that is, the image data for magenta (M), and a toner image of magenta (M) is formed as superposed on the above-mentioned toner image of yellow (Y) by the non-contact reverse development by the developing unit 13 for M.

By a similar process, a toner image of cyan (C) corresponding to the third color signal and a toner image of black (K) corresponding to the fourth color signal are formed successively superposed on the former toner images, by the scorotron charger 11 for C, the exposure optical system 12 for C, and the developing unit 13 for C, and by the scorotron charger 11 for K, the exposure optical system 12 for K, and the developing unit 13 for K; thus, a color toner image is formed on the circumferential surface of the photoreceptor drum 10 within one rotation of the drum.

As described in the above, in this embodiment, the exposure for the organic photosensitive layer of the photoreceptor drum 10 by the exposure optical systems 12 for each of the colors Y, M, C, and K is carried out from the inside of the photoreceptor drum 10 through the transparent base member. Accordingly, it is possible that the image exposures corresponding to the second, third, and fourth color signals respectively are not intercepted by the toner images formed before, to form an electrostatic latent image; this is desirable, but exposure may be carried out from the outside of the photoreceptor drum 10.

On the other hand, the recording paper sheet P as a transfer material is fed out from the paper feeding cassette 15 as a transfer material storing means by a conveying-out roller (no sign in the drawing), and is conveyed by a pair of conveyance roller (no sign in the drawing) to the timing roller 16.

Synchronized with the color toner image carried on the photoreceptor drum 10 by the driving of the timing roller 16, the recording paper sheet P is conveyed to the transfer zone as attracted to the conveyance belt 14*a* by the charging made by the paper charger 150 as a paper charging means. To the recording paper sheet P, which has been conveyed by the conveyance belt 14*a* in close contact with it, the color toner images on the circumferential surface of the photoreceptor drum 10 are transferred all at a time in the transfer zone by the transfer charger 14*c* as a transfer means to which an electric voltage of the reverse polarity to the toners (positive polarity in this embodiment).

After the charge on the recording paper sheet P, to which the color toner images are transferred, is eliminated by the AC charge eliminator 14*h* for detaching a paper sheet as a transfer material detaching means, the recording paper sheet P is detached from the conveyance belt 14*a,* and is conveyed to the fixing apparatus 17.

The fixing apparatus is composed of the ray fixing roller 17*a* as an upper roll-shaped rotary member for applying heat for fixing a color toner image, and the fixing roller 47*a* as a lower roll-shaped rotary member for applying heat, and at the center inside the ray fixing roller 17*a,* it is disposed a halogen lamp 171*g* which radiates heat rays such as infrared rays including visible rays in the case of some kind of the light source or far infrared rays, a xenon lamp (not shown in the drawing), or the like as a ray-radiating device for radiating heat rays.

The recording paper sheet P is gripped in the nip portion N formed between the ray fixing roller 17*a* and the fixing roller 47*a,* and by applying heat and pressure, the color toner image on the recording paper sheet P is fixed; then the recording paper sheet P is conveyed by the ejection roller 18, and is ejected onto the tray on the upper side of the apparatus.

The toner particles remaining on the circumferential surface of the photoreceptor drum 10 after transfer is removed by the cleaning blade 19*a* provided in the cleaning unit 19 as a means for cleaning an image forming member. The photoreceptor drum 10, from which the residual toner particles have been removed, is subjected to a uniform charging by the scorotron charger 11, and enters into the next image forming cycle.

As shown in FIG. 3, the fixing apparatus 17 is composed of the ray fixing roller 17*a* as an upper roll-shaped rotary member for applying heat having elasticity for fixing a toner image on a transfer material, and the fixing roller 47*a* as a lower roll-shaped rotary member for applying heat, and grips the recording paper sheet P in the nip portion N having a width of 5 to 20 mm or so formed between the ray fixing roller 17*a* having elasticity and the fixing roller 47*a,* to fix the toner image on the recording paper sheet P by applying heat and pressure. On the circumference of the ray fixing roller 17*a* as a roll-shaped rotary member for applying heat provided at the upper side, there are provided the fixing pick-off finger TR6, the fixing oil removing roller TR1, heat equalizing roller TR7, the oil-coating felt TR2, the oil regulating blade TR3 in the above-mentioned order from the position of the nip portion N to the rotating direction of the ray fixing roller 17*a,* and the ray fixing roller 17*a* is coated by the oil coating felt TR2 with the oil, which has been supplied from the oil tank TR4 through the capillary pipe TR5 to the oil coating felt TR2. The oil on the circumferential surface of the ray fixing roller 17*a* is removed by the fixing oil removing roller TR1. Accordingly, the heat equalizing roller TR7 and the temperature sensor TS1, which is a temperature sensing means for measuring the temperature of the ray fixing roller 17*a,* are provided on the cleaned circumferential surface of the ray fixing roller 17*a* between the fixing oil removing roller TRl and the oil coating felt TR2. The transfer material after fixing is detached by the fixing pick-off finger TR6. Further, the temperature distribution resulting from the heat generation on the circumferential surface of the ray fixing roller 17*a,* which is heated by the ray absorbing layer for generating heat 171*b,* is made uniform by the heat equalizing roller TR7, which is a roller member made of a metal having a good thermal conductivity, such as an aluminum material or a stainless steel material, or a heat pipe. Owing to the heat equalizing roller TR7, it can be made uniform, the non-uniformity of temperature in the longitudinal direction and in the lateral direction on the ray fixing roller 17*a,* which has been produced by the passing-through of a transfer material.

The ray fixing roller 17*a* as a rotary member for applying heat for fixing a toner image on a transfer material has a structure of a soft roller, which is made up of the cylindrical-shaped transparent base member 171*a,* and the layers which are provided in the above-mentioned order on the outside (outer circumferential surface) of said transparent base member 171*a,* namely, the ray-transmitting elastic layer 171*d* (or the ray-transmitting heat insulating layer 171*e* to be described later), the ray absorbing layer for generating heat 171*b,* and the releasing layer 171*c.* At the center inside the ray fixing roller 17*a,* it is disposed a halogen lamp 171*g* which radiates heat rays such as infrared rays including visible rays in the case of some kind of the light source or far infrared rays, a xenon lamp (not shown in the drawing), or the like as a ray-radiating device for radiating heat rays. The ray fixing roller 17*a* as a rotary member for applying heat is made up as a soft roller having a high elasticity in such a manner as to be described later. The heat rays radiated from the halogen lamp 171*g* or a xenon lamp (not shown in the drawing) are absorbed by the ray absorbing layer for generating heat 171*b;* therefore, a roll-shaped rotary member for applying heat capable of rapid heating can be formed.

Further, the fixing roller 47*a* as a lower roll-shaped rotary member for applying heat has a structure of a soft roller, which is made up of the cylindrical-shaped metallic pipe 471*a* made of, for example, an aluminum material, and the thin rubber layer 471*b* to make a rubber roller having a thickness of 1 to 3 mm made of, for example, a silicone material provided on the outer circumferential surface of said metallic pipe 471*a.* For the lower roll-shaped rotary member for applying heat, an elastic rubber roller having a high heat insulating ability (an elastic roller using foamed sponge material inside the roller) is used, which prevents the heat transfer from the upper rotary member for applying heat to the lower rotary member for applying heat, while securing a broad nip width. Further, the heat equalizing roller TR7, which is made of a metal material of good thermal conductivity such as an aluminum material or a stainless steel material, is provided also on the surface of the rubber roller 471*b* in rolling contact with it, and owing to this heat equalizing roller TR7, the temperature distribution on the circumferential surface of the fixing roller 47*a* is made uniform. For the heat equalizing roller TR7, it is desirable to use a heat pipe which is capable of both storing heat and dissipating heat. Further, it is possible also to provide a halogen lamp 471*c* as a heat generating source at the center inside the metallic pipe 471*a.* Of course, it is appropriate to use the same structure as the upper ray fixing roller 17*a* of this invention for the lower rotary member for applying heat.

A plane-shaped nip portion N is formed between the upper soft roller and the lower soft roller, to make the fixing of a toner image.

TS1 denotes a temperature sensor attached to the upper ray fixing roller 17*a* for carrying out temperature control using, for example, a thermister of a contact type, and TS2 denotes a temperature sensor attached to the lower fixing roller 47*a* for carrying out temperature control using, for example, a thermister of a contact type. For the temperature sensors TS1 and TS2, instead of the one of a contact type, a thermister of a non-contact type can be used.

Figure 4:
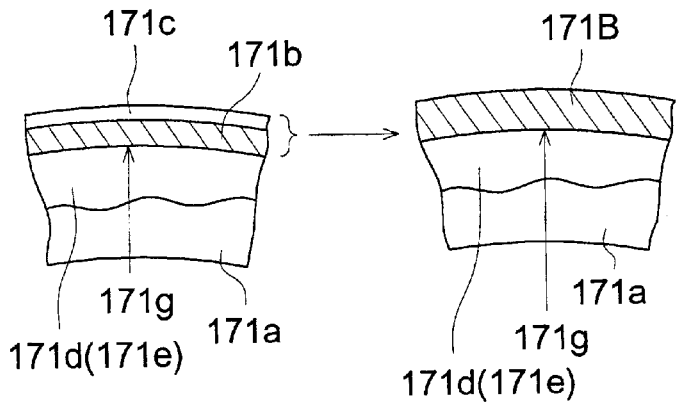
FIG. 4(*a*) and FIG. 4(*b*) are enlarged cross-sectional views showing the structure of the roll-shaped rotary member for applying heat shown in FIG. 3.

According to FIG. 4(*a*) and FIG. 4(*b*), the cross-section of the ray fixing roller 17*a* is such one as shown in FIG. 4(*a*); for the material of the cylindrical-shaped ray-transmitting base member 171*a* having a thickness of 1 to 4 mm, or desirably 1.5 to 3 mm, Pyrex glass, sapphire ($Al_2O_3$), or a ceramic material such as $CaF_2$ (having a thermal conductivity of (0.5 to 2) W/m·K, a specific heat of (0.5 to 2.0)$\times10^{-2}$ J/kg·K, and a specific weight of 1.5 to 3.0) is mainly used. It is possible to use a transparent resin material such as a polyimide or a polyamide (having a thermal conductivity of (2 to 4) W/m·K, a specific heat of (1 to 2)$\times10^{-2}$ J/kg·K, and a specific weight of 0.8 to 1.2). For example, in the case where a Pyrex glass tube having an inner diameter of 32 mm, outer diameter of 40 mm, and a thickness of 4 mm (having a specific heat of $0.97\times10^{-3}$ J/kg·K, and a specific weight of 2.32) is used for the ray-transmitting base member 171*a* of the ray fixing roller 17*a,* the heat capacity Q1 of the ray-transmitting base member 171*a* per width of A-3 size (297 mm) is approximately 240 J/deg. As described in the above, the ray-transmitting base member has not so good a thermal conductivity.

The ray-transmitting elastic layer 171*d* is formed of a rubber layer (base layer) having a thickness of 1 to 4 mm, or desirably 2 to 3 mm, made of a material transmitting heat rays (infrared rays including visible rays in the case of some king of the light source or far infrared rays) such as a silicone rubber or a fluorine-contained rubber capable of transmitting heat rays. For the ray-transmitting elastic layer 171*d,* it is adopted a method for improving the thermal conductivity by adding the powders of metal oxides such as silica, alumina, and magnesium oxide in the base layer as a filler in order to cope with the speed being made higher, and a silicone rubber layer or a fluorine-contained rubber layer having a thermal conductivity of (1 to 3) W/m·K, a specific heat of (1 to 2)$\times10^{-2}$ J/kg·K, and a specific weight of 0.9 to 1.0 is used. In the case, for example, where a silicone rubber (having a specific heat of $1.2\times10^{3}$ J/kg·K, and a specific weight of 0.91) layer having an outer diameter of 48 mm and a layer thickness of 4 mm is used for the ray-transmitting elastic layer 171*d* of the ray fixing roller 17*a,* the heat capacity Q2 of the ray-transmitting elastic layer 171*d* per width of A-3 size (297 mm) is approximately 160 J/deg. Because the silicone rubber layer or the fluorine-contained rubber layer has a lower thermal conductivity than the transparent base member 171*a* using a glass material (having a thermal conductivity of (5 to 20) w/m·K), it plays a role of a heat insulating layer. There is a tendency that, generally speaking, the hardness of a rubber is raised by making the thermal conductivity higher, and for example, one usually having a hardness of 40 Hs may be raised to one having a hardness about 60 Hs (JIS, spring method hardness test type A). A desirable rubber hardness is 5 to 60 Hs. Further, because the wavelength of the heat rays transmitted by the ray-transmitting elastic layer 171*d* is 0.1 to 20 μm, or desirably 0.3 to 3 μm, the above-mentioned. filler to be used as an adjusting agent for hardness and thermal conductivity is composed of fine particles of any one or more of the metal oxides capable of transmitting heat rays (infrared rays including visible rays in the case of some kind of the light source or far infrared rays), which have a diameter equal to or smaller than ½, desirably ⅕, of the wavelength of the heat rays, or in other words, an average diameter, averaged for the particles including primary particles and secondary particles, equal to or smaller than 1 μm, or desirably 0.1 μm or under, such as titanium oxide, aluminum oxide, zinc oxide, silicon oxide, magnesium oxide, and calcium carbonate, and it is also possible that the ray-transmitting elastic layer 171*d* is formed of the above-mentioned particles dispersed in a resin binder. It is desirable that the average diameter for the particles including the primary and secondary ones in the layer is equal to 1 μm or under, or desirably 0.1 μm or under, because it prevents the light scattering to let the light reach the ray absorbing layer for generating heat 171*b*. By providing the ray-transmitting elastic layer 171*d*, the ray fixing roller 17*a* as a rotary member for applying heat has a structure of a soft roller having a high elasticity. Further, it is possible also to use the ray-transmitting heat insulating layer 171*e* having only the effect of heat insulating property as a non-elastic layer of transparent resin etc., instead of the ray-transmitting elastic layer 171*d* having a heat insulating property, for the ray fixing roller 17*a* as a rotary member for applying heat of this invention.

For the ray absorbing layer for generating heat 171*b*, in order that 90 to 100%, desirably 95 to 100%, of the remainder of heat rays after a part of the heat rays radiated from the halogen lamp 171*g* or a xenon lamp (not shown in the drawing) are absorbed by the ray-transmitting base member 171*a* and the ray-transmitting elastic layer (or the ray-transmitting heat insulating layer 171*e*), that is, of the heat rays transmitted by the transparent base member 171*a* and the ray-transmitting elastic layer 171*d* (or ray-transmitting heat insulating layer 171*e*) may be absorbed by the ray absorbing layer for generating heat 171*b* to form a rotary member for applying heat capable of being heated up rapidly, using a heat ray absorbing material composed of powders of any one or more of carbon black, graphite, iron black ($Fe_3O_4$), various kinds of ferrites and their compounds, copper oxide, cobalt oxide, rouge ($Fe_2O_3$), etc. mixed with a resin binder, a layer of the heat ray absorbing material having a thickness of 10 to 500 μm, or desirably 20 to 100 μm, is formed on the outside (outer circumferential surface) of the ray-transmitting elastic layer 171*d* (or the ray-transmitting heat insulating layer 171*e*) by spraying, coating, or the like. The thermal conductivity of the ray absorbing layer for generating heat 171*b* can be determined to a value of (3 to 100) W/m·K, which is higher than the above-mentioned ray-transmitting elastic layer 171*d* (having a thermal conductivity of (1 to 10) W/m·K) owing to the addition of the heat absorbing agent such as carbon black. The specific heat of the ray absorbing layer for generating heat 171*b* is about $2.0\times10^3$ J/kg·K, and its specific weight is about 0.9. For the ray absorbing layer for generating heat 171*b*, it is also appropriate to provide a metallic roller member such as a electroformed nickel roller having the same thickness as the above. In this case, it is desirable that the inner side (inner circumferential surface) is subjected to black oxidation processing in order to absorb heat rays. If the heat ray absorbing efficiency of the ray absorbing layer for generating heat 171*b* is lower than about 90%, for example, 20 to 80% or so, heat rays leak out; in the case where ray fixing roller 17*a* as a rotary member for applying heat is used in forming a monochromatic image, if black toner particles adhere to the surface of the ray fixing roller 17*a* at a specific position by toner filming or the like, heat is generated at the adhering portion by the leaking heat rays, to damage the ray absorbing layer for generating heat 171*b*. Further, in the case where it is used in forming a color image, poor fixing or uneven fixing occurs because the heat absorbing efficiency of color toners is generally low and there are differences of heat absorbing efficiency among the color toners. Accordingly, in order that the remainder of heat rays after a part of the heat rays radiated from the halogen lamp 171*g* or a xenon lamp (not shown in the drawing) are absorbed by the transparent base member 171*a*, that is, the heat rays transmitted by the transparent base member 171*a* and the ray-transmitting elastic layer 171*d* (or ray-transmitting heat insulating layer 171*e*) may be absorbed completely by the ray absorbing layer 171*b*, the heat absorbing efficiency of the ray absorbing layer for generating heat 171*b* is made to be 90 to 100%, desirably 95 to 100%. Owing to this, the fusing of the color toner particles, which are difficult to be fixed by heat rays for the reason of different spectral characteristics, can be made satisfactorily, and in particular, in the color image formation shown in FIG. 1, the fusing of the superposed color toner images on a transfer material having a thick toner layer which are difficult to be fixed by heat rays for the reason of different spectral characteristics can be carried out satisfactorily. Further, if the thickness of the ray absorbing layer for generating heat 171*b* is thin as 10 μm or under, the speed of heating-up based on the absorption of heat rays in the ray absorbing layer for generating heat 171*b* is fast, but it becomes the cause of the breakdown or the insufficient mechanical strength of the ray absorbing layer for generating heat 171*b* owing to the local heating by the thin film, and if the thickness of the ray absorbing layer for generating heat 171*b* is too thick as over 500 μm, the thermal conduction becomes poor, or the heat capacity becomes large to make rapid heating up difficult. By making the heat ray absorbing efficiency of the ray absorbing layer for generating heat 171*b* 90 to 100%, or desirably 95 to 100%, or by making the thickness of the ray absorbing layer for generating heat 171*b* 10 to 500 μm, or desirably 20 to 100 μm, the local heat generation in the ray absorbing layer for generating heat 171*b* is prevented, and uniform heat generation is made. Further, because the wavelength of the heat rays irradiating the ray absorbing layer for generating heat 171*b* is 0.1 to 20 μm, desirably 0.3 to 3 μm, an adjusting agent of hardness and thermal conductivity is added in the layer as a filler; it is appropriate also to form the ray absorbing layer for generating heat 171*b* of fine particles of one or more of metal oxides of 5 to 50% by weight dispersed in a resin binder, said fine particles being capable of transmitting heat rays (infrared rays including visible rays in the case of some kind of the light source or far infrared rays), having a diameter equal to or smaller than ½, desirably ⅕, of the wavelength of the heat rays, or in other words, an average diameter, averaged for the particles including the primary and secondary ones, equal to or smaller than 1 μm, or desirably 0.1 μm, and being composed of metal oxides such as titanium oxide, aluminum oxide, zinc oxide, silicon oxide, magnesium oxide, calcium carbonate. By doing this, heat rays are made to enter inside the ray absorbing layer for generating heat 171*b*, and heat generation at the border surface can be prevented. In this way, the ray absorbing layer for generating heat 171*b* has a small heat capacity in order that its temperature may be quickly raised, therefore, it is prevented the problem that a temperature drop is produced in the ray fixing roller 17*a* as a rotary member for applying heat, and uneven fixing occurs. For the ray absorbing layer for generating heat 171*b,* powders of carbon black, graphite, iron black ($Fe_3O_4$), various kinds of ferrites and their compounds, copper oxide, cobalt oxide, rouge ($Fe_2O_3$), or the like mixed in a silicone rubber or a fluorine-contained rubber having elasticity can be appropriately used. For example, in the case where a fluorine-contained resin layer (having a specific heat of $2.0\times10^3$ J/kg·K and a specific weight of 0.9) having a thickness of 100 $\mu$m on the surface of the ray-transmitting elastic layer 171*d* having an outer diameter of 48 mm is used for the ray absorbing layer for generating heat 171*b* (or the layer having a combined function 171B to be described later) of the ray fixing roller 17*a,* the heat capacity Q3 of the ray absorbing layer for generating heat 171*b* (or the layer having a combined function) per width of A-3 size (297 mm) is approximately 4 J/deg. It is possible also to use a metallic film member such as an electroformed nickel belt for the ray absorbing layer for generating heat 171*b.* In this case, it is desirable that the inner side (inner circumferential surface) is subjected to black oxidation processing.

Further, in order to make high the releasing ability against the toners, on the outside (outer circumferential surface) of the ray absorbing layer for generating heat 171*b,* there is provided separately from the ray absorbing layer for generating heat 171*b,* the releasing layer 171*c* having a thermal conductivity of (3 to 100) W/m·K, which is formed of a covering tube of PFA (fluorine-contained resin) having a thickness of 20 to 100 $\mu$m, a coated layer of a fluorine-contained resin (PFA or PTFE) paint having a thickness of 20 to 100 $\mu$m, or a molded layer of a silicone rubber or a fluorine-contained rubber having a thickness of 20 to 500 $\mu$m (separate type).

Further, as the cross-section is shown in FIG. 4(*b*), it is appropriate also to form a roll-shaped rotary member for applying heat having elasticity, by forming the layer of the combined function 171B having a releasing property, which is composed of powders of any one or more out of carbon black, graphite, iron black ($Fe_3O_4$), various kinds of ferrites and their compounds, copper oxide, cobalt oxide, rouge ($Fe_2O_3$), etc. mixed in a fluorine-contained resin (PFA or PTFE) paint or a silicone rubber, a fluorine-contained rubber, or the like, to make a single layer having the combined function of the ray absorbing layer for generating heat 171*b* and the releasing layer 171*c,* which are described before with reference to FIG. 4(*a*). The thermal conductivity of the layer of the combined function 171B is approximately the same as that of the ray absorbing layer for generating heat 171*b,* namely, (3 to 10) W/m·K. In the same way as described in the above, in order that the remainder of heat rays after a part of the heat rays radiated from the halogen lamp 171*g* or a xenon lamp (not shown in the drawing) are absorbed by the transparent base member 171*a,* that is, the heat rays transmitted by the transparent base member 171*a* and the ray-transmitting elastic layer 171*d* (or ray-transmitting heat insulating layer 171*e*) may be absorbed completely, the heat absorbing efficiency of the layer of the combined function 171B is made to be 90 to 100%, desirably 95 to 100%. If the heat ray absorbing efficiency in the layer of the combined function 171B is lower than about 90%, for example, 20 to 80% or so, heat rays leak out; in the case where ray fixing roller 17*a* as a rotary member for applying heat is used in forming a monochromatic image, when black toner particles adhere to the surface of the ray fixing roller 17*a* at a specific position by toner filming or the like, heat is generated at the adhering portion by the leaking heat rays to damage the layer of the combined function 171B. Further, in the case where it is used in forming a color image, poor fixing or uneven fixing occurs because the heat absorbing efficiency of color toners is generally low and there are differences of heat absorbing efficiency among the color toners. Accordingly, in order that the remainder of heat rays after a part of the heat rays radiated from the halogen lamp 171*g* or a xenon lamp (not shown in the drawing) are absorbed by the transparent base member 171*a,* that is, the heat rays transmitted by the transparent base member 171*a* and the ray-transmitting elastic layer 171*d* (or ray-transmitting heat insulating layer 171*e*) may be absorbed completely, the heat absorbing efficiency of the layer of the combined function 171B is made to be 90 to 100%, or desirably 95 to 100%. Further, the local heat generation in the layer of the combined function 171B is prevented, and a uniform heat generation is made. Further, because the wavelength of the heat rays irradiating the layer of the combined function 171B is 0.1 to 20 $\mu$m, desirably 0.3 to 3 $\mu$m, the adjusting agent of hardness and thermal conductivity is added in the layer as a filler; it is appropriate also to form the layer of the combined function 171B of fine particles of metal oxides dispersed in a resin binder, said fine particles of metal oxides being capable of transmitting heat rays (infrared rays including visible rays in the case of some light sources or far infrared rays), having a diameter equal to or smaller than ½, desirably ⅕, of the wavelength of the heat rays, or in other words, an average diameter, averaged for the particles including the primary particles and secondary ones, equal to or smaller than 1 $\mu$m, desirably 0.1 $\mu$m, and being composed of any one or more of metal oxides such as titanium oxide, aluminum oxide, zinc oxide, silicon oxide, magnesium oxide, calcium carbonate.

According to FIG. 5, if the above-mentioned heat ray absorbing material is mixed in the ray absorbing layer for generating heat 171*b* of the ray fixing roller 17*a* as a roll-shaped rotary member for applying heat, with its concentration distribution made uniform as shown by the dotted line (a-1), the heat generation distribution in the ray absorbing layer for generating heat 171*b* becomes such one as shown by the curved line (b-1) concentrated at the border zone of the ray absorbing layer for generating heat 171*b,* which makes heat easy to flow out toward the ray-transmitting elastic layer 171*d* (or the ray-transmitting heat insulating layer 171*e*); therefore, it is desirable from the view point of dispersing the heat generation distribution, to provide a concentration distribution for generating heat in the inner portion of the ray absorbing layer for generating heat 171*b.* For this purpose, as shown by the dotted line (a-2), the concentration distribution in the ray absorbing layer for generating heat 171*b* is made to be such one that the concentration is made lower at the border surface with the ray-transmitting elastic layer 171*d* (or the ray-transmitting heat insulating layer), which is adjacent to it at the inner side, and made higher gradually with a tilt toward the outer circumferential surface, to reach the saturation value of the concentration which enables that 100% of the heat rays are absorbed in the layer, at the position of ½ to ⅗ from the inner side to the outer circumferential surface (with respect to the thickness t1 of the ray absorbing layer for generating heat 171*b,* from the side of the ray-transmitting elastic layer 171*d* or the ray-transmitting heat insulating layer 171*e*). By doing this, as shown by the curved line (b-2), the heat generation distribution owing to the-absorption of heat rays in the ray absorbing layer for generating heat 171*b* becomes such one that the position of the maximum value of the heat generation in the layer is moved to a distance in the range from ⅓ to ⅖ of the thickness t1 of the ray absorbing layer for generating heat 171*b* from the border with the ray-transmitting elastic layer 171*d* (or the ray-transmitting heat insulating layer 171*e*), which makes small the amount of heat flowing out, and at the same time, eliminates the influence of the shaving-off of the outer circumferential surface, in particular, even in the case where the layer of combined function 171B is used. Further, as shown by the dotted line (a-3), it is desirable that the concentration forms a saturated area with a constant gradient; owing to this, as shown by the curved line (b-3), the heat generation distribution curve in the ray absorbing layer for applying heat 171*b* is formed with a shape like a parabola which has a maximum in the neighborhood of the center of the ray absorbing layer for generating layer 171*b,* and becomes minimum at the border and near the outer circumferential surface of the layer 171*b,* which eliminates the influence of the shaving-off of the outer circumferential layer, and in particular, eliminates the influence of the flowing-out of heat. In short, if the absorption of heat is sufficiently done inside the layer, the influence of the concentration near the outside is eliminated, and the influence of shaving-off is not produced. Further, it is possible also to provide the above-mentioned gradient in the concentration distribution of the ray absorbing material to adjust the heat generation distribution by varying the angle of the gradient.

Further, as shown in FIG. 6, for the average outer diameter ϕ of the cylindrical ray-transmitting base member 171*a* of the ray fixing roller 17*a* as a roll-shaped rotary member for applying heat, 16 to 60 mm is used; for the average thickness t, the thicker one is better in mechanical strength, and the thinner one is better in heat capacity; from an appropriate balance of mechanical strength and the heat capacity, the relation between the average outer diameter ϕ and the average thickness t of the cylindrical ray-transmitting base member 171*a* is given by the following inequalities:

$$0.02 \leqq t/\phi \leqq 0.20,$$

or desirably, $$0.04 \leqq t/\phi \leqq 0.10.$$

For the average outer diameter ϕ of the ray-transmitting base member 171*a* of 40 mm, the ray-transmitting base member 171*a* having an average thickness expressed by 0.8 mm≦t≦8.0 mm, or desirably by 1.6 mm≦t≦4.0 mm is used. If t/ϕ of the ray-transmitting base member 171*a* is equal to or smaller than 0.02, the mechanical strength is insufficient, and if it exceeds 0.20, the heat capacity becomes too large, and the heating time of the ray fixing roller 171*a* is prolonged. Further, in the case of some material for the ray-transmitting base member 171*a,* 5 to 25% of heat rays are absorbed, even though the layer is called ray-transmitting; therefore, a thinner one is desirable so long as the mechanical strength is secured. Similarly, in the case of some material for the ray-transmitting elastic layer 171*d,* 5 to 25% of the heat rays are absorbed, even though the layer is called ray-transmitting; therefore, a thinner one is desirable so long as the mechanical strength is secured.

By adopting the fixing apparatus 17 explained with reference to FIG. 3, it can be provided a fixing apparatus which withstands the deformation at the fixing portion (nip portion) and also is capable of quick starting (rapid heating); further, by the pressure application at the soft fixing portion (nip portion) owing to the elasticity of the rotary member for applying heat, and by the heating by means of the ray absorbing layer for applying heat of said rotary member for applying heat, the fusing of color toners which are difficult to be fixed by heat rays for the reason of the mutually different spectral characteristics can be carried out satisfactorily, which makes it possible to make a quick-start (rapid heating) fixing of color toners. Moreover, the effect of economizing energy can be obtained.

However, in the above-mentioned fixing apparatus 17, the ray-transmitting base member 171*a* of the ray fixing roller 17*a* as a rotary member for applying heat mainly made of a glass material has a poor cylindricity and roundness and an uneven thickness, which produces also an unevenness of thickness in the ray-transmitting elastic layer 171*d* or the ray-transmitting heat insulating layer 171*e* provided on the outside (outer circumferential surface) of the ray-transmitting base member 171*a,* and further makes non-uniform the temperature distribution inside the ray fixing roller 17*a* as a rotary member for applying heat and makes uneven the light quantity reaching the ray absorbing layer for generating heat 171*b* at the surface; therefore, non-uniformity of heat generation in the ray absorbing layer for generating heat 171*b* at the surface is produced, and it occurs a problem that the temperature of the ray absorbing layer for generating heat 171*b* is unstable or non-uniform. Further, in the above-mentioned fixing apparatus 17, if heat is generated in the ray absorbing layer for generating heat 171*b* at the surface only, it occurs also a problem such that the temperature of the layers under the ray absorbing layer for generating heat 171*b* is low, which makes the temperature of the ray absorbing layer for generating heat 171*b* at the time of printing immediately drop, and the hysteresis in the portion through which transfer materials pass remains for a long time, to produce a temperature fluctuation in the rotary member for applying heat.

Figure 7:
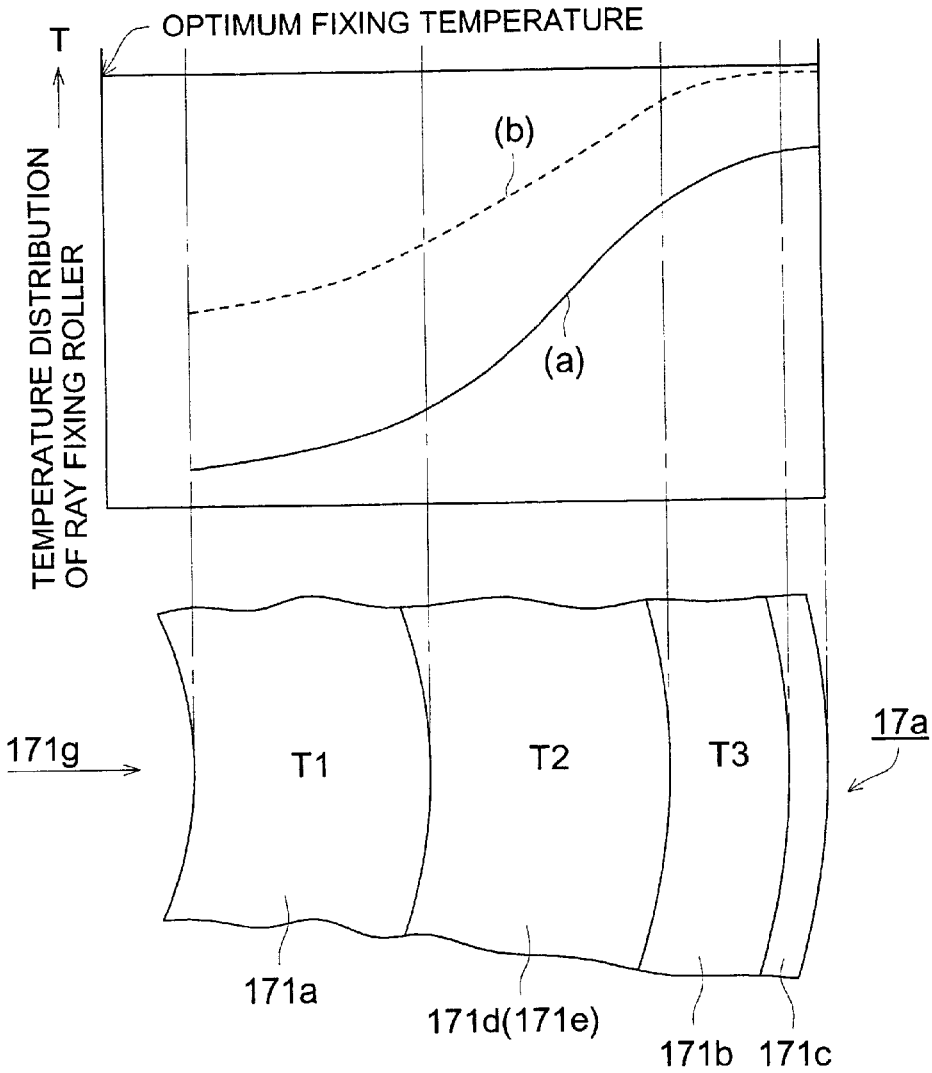
FIG. 7 is a drawing showing the average temperature in the layer and the temperature distribution of each of the layers of the rotary member for applying heat when the temperature is raised.
Figure 8:
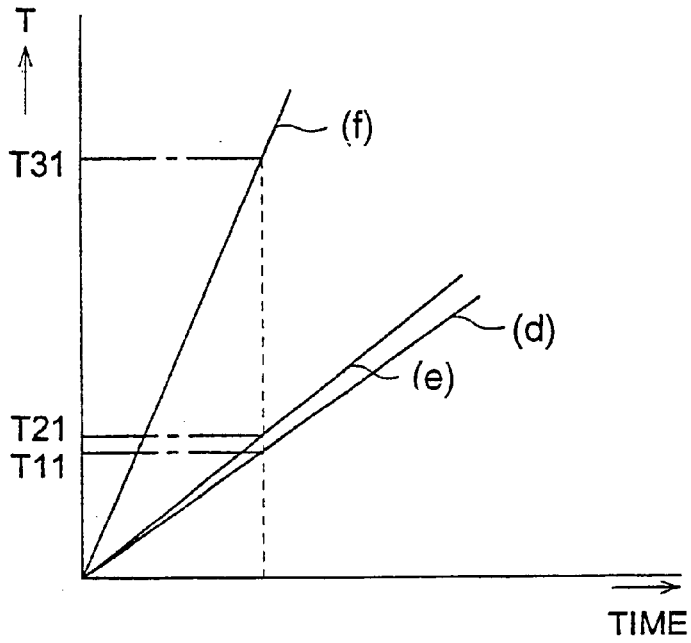
FIG. 8 is a drawing showing the rate of temperature rise for each of the layers of the rotary member for applying heat as a single layer at the time of raising the temperature.
Figure 9:
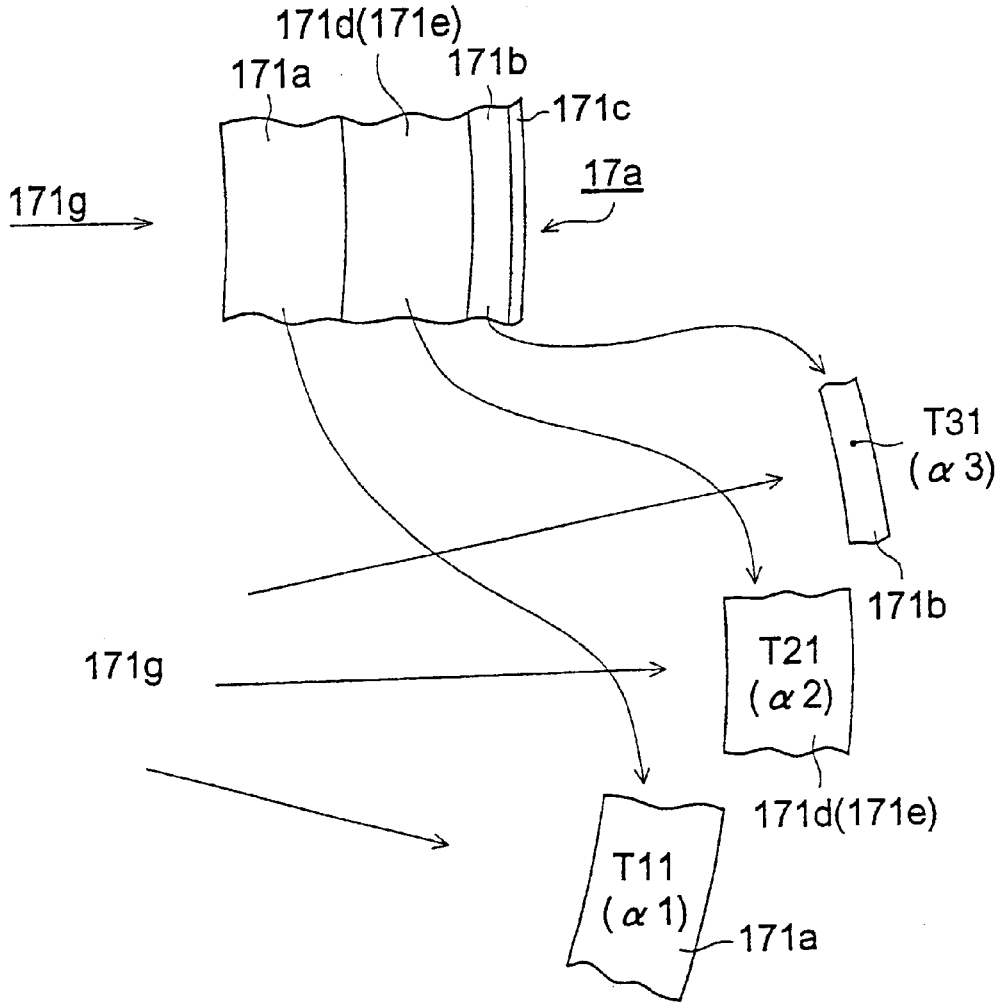
FIG. 9 is a drawing showing the heat ray absorbing ratio per unit thickness for each of the layers of the rotary member for applying heat as a single layer.

With reference to FIG. 7 to FIG. 9, and above-mentioned FIG. 4(*a*) and FIG. 4(*b*), the conditions to be set for preventing the temperature fluctuation of the rotary member for applying heat for use in the above-mentioned fixing apparatus, the relation between the thickness of the ray-transmitting base member and the thickness of the ray-transmitting elastic layer (or the ray-transmitting heat insulating layer), and the relation between the heat ray absorbing ratio as a single layer and the heat absorbing ratio of the ray-transmitting elastic layer (or the ray-transmitting heat insulating layer) as a single layer will be explained. FIG. 7 is a drawing showing the average temperature and the temperature distribution in each of the layers at the time of raising the temperature of the rotary member for applying heat, FIG. 8 is a drawing showing the rate of the temperature rise as a single layer for each of the layers of the rotary member for applying heat at the time of raising the temperature, and FIG. 9 is a drawing showing the temperature rise per unit time as a single layer for each of the layers and the heat absorbing ratio per unit thickness as a single layer for each of the layers of the rotary member for applying heat.

As described in the foregoing, in a conventional fixing apparatus, by the heat generation in the ray absorbing layer for generating heat at the surface only, warm-up time can be shortened, but the temperature of the layers under the ray absorbing layer for generating heat is low, which makes the temperature of the ray absorbing layer for generating heat at the time of printing immediately drop, and the hysteresis in the portion through which transfer materials pass remains for a long time, to produce a temperature fluctuation in the rotary member for applying heat; therefore, as shown in FIG. 7, the average temperatures, not only in the ray absorbing layer for generating heat 171*b* at the surface but also in the other layers, at the time of raising the temperatures by the heat rays from the halogen lamp 171*g* or a xenon lamp (not shown in the drawing) in the case where the layers are in the state of composing the ray fixing roller 17*a,* are made to be such ones as to become higher in the order of the ray-transmitting base member 171*a,* the ray-transmitting elastic layer 171*d* (or the ray-transmitting heat insulating layer 171*e*), and the ray absorbing layer for generating heat 171*b* from the lowest of the first one. That is, let T1 (°C.) be the average temperature in the layer of the ray-transmitting base member 171*a,* T2 (°C.) be the average temperature in the layer of the ray-transmitting elastic layer 171*d* or the ray-transmitting heat insulating layer 171*e,* and T3 (°C.) be the average temperature in the layer of the ray absorbing layer for generating heat 171*b,* then it is desirable for the absorbing rate or the absorbed amount of heat is made to satisfy the following inequalities:

$$T1<T2<T3.$$

Owing to this, it is prevented that the temperature of the ray absorbing layer for generating heat drops immediately at the time of printing, or that the hysteresis in the portion through which transfer materials pass remains for a long time, while the temperature fluctuation of the rotary member for applying heat is also prevented. For the temperature distribution in the ray fixing roller 17*a* during temperature rise in this case, the temperature distribution in the initial stage of heating becomes as shown by the curved line (a), and the temperature of the ray absorbing layer for generating heat at the surface can be raised quickly, but the inside of the rotary member for applying heat remains cool and its temperature is still low, because more heat is generated in the ray absorbing layer for generating heat 171*b* than the ray-transmitting base member 171*a* in the inner portion and the ray-transmitting elastic layer 171*d* (or the ray-transmitting heat insulating layer 171*e*) [in the initial stage of heating]. Further, the temperature distribution in the later stage becomes such one as shown by the curved line (b), and the temperature of the ray absorbing layer for generating heat 171*b* at the surface has been raised almost to the temperature suitable for fixing, as well as the temperature of the ray-transmitting elastic layer (or the ray-transmitting heat insulating layer 171*e*) has been raised fairly close to the temperature suitable for fixing, while the ray-transmitting base member 171*a* located at the inner portion of the rotary member for applying heat still remains in the state of low temperature.

As described in the above, by making the absorbing rate or the absorbed amount of heat in the layer at the time of raising the temperatures, in the case where the layers are in the state of composing the rotary member for applying heat, to be such ones as to become higher in the order of the ray-transmitting base member, the ray-transmitting elastic layer or the ray-transmitting heat insulating layer, and the ray absorbing layer for generating heat, not only in the ray absorbing layer for generating heat at the surface, but also in the layers located under, that is, the ray-transmitting base member and the ray-transmitting elastic layer or the ray-transmitting heat insulating layer, a certain amount of heat absorption occurs, and during printing, the temperature drop in the ray absorbing layer and the hysteresis in the portion through which transfer materials pass can be prevented, which makes the temperature of the rotary member for applying heat stabilized, while enabling the shortening of warm-up time.

Further, as described before in FIG. 7, in the case where the layers are in the state of composing the ray fixing roller 17*a,* it is necessary to take it into consideration the absorption of heat rays by the members at the inner side of the ray absorbing layer for generating heat 171*b*; now, according to FIG. 8 or FIG. 9, the rate of temperature rise in the ray-transmitting base member 171*a* as a single layer, the rate of temperature rise in the ray-transmitting elastic layer 171*d* (or the ray-transmitting heat insulating layer) as a single layer, and the rate of temperature rise in the ray absorbing layer for generating heat 171*b* are shown by the straight line (d) in FIG. 8, by the straight line (e) in FIG. 8, and by the straight line (f) in FIG. 8, respectively; further, the temperature rise per unit time in the case where each of the layers as a single layer is irradiated by heat rays from the halogen lamp 171*g* or a xenon lamp (not shown in the drawing), (the temperature rise per unit time in the case where each of the layers is separately irradiated by heat rays) is shown in FIG. 9. Now, at the time of raising the temperature, let T11 (°C.) be the temperature rise per unit time of the ray-transmitting base member 171*a* as a single layer, T21 (°C.) be the temperature rise per unit time of the ray-transmitting elastic layer 171*d* or the ray-transmitting heat insulating layer 171*e* as a single layer, and T31 (°C.) be the temperature rise per unit time of the ray absorbing layer for generating heat 171*b* as a single layer, then it is desirable that the absorbing rate or the absorbed amount of heat is made to satisfy the following inequalities:

$$T11<T21<T31.$$

Owing to this, it is prevented that the temperature of the ray absorbing layer for generating heat drops immediately at the time of printing, or that the hysteresis in the portion through which transfer materials pass remains for a long time, while the temperature fluctuation of the rotary member for applying heat is also prevented. Further, it is more desirable that they satisfy following inequalities: T21>2×T11, T31>10×T11, and T31>5×T21; then, it is more sufficiently prevented that the temperature of the ray absorbing layer for generating heat drops immediately at the time of printing, or that the hysteresis in the portion through which transfer materials pass remains for a long time, while the temperature fluctuation of the rotary member for applying heat is also more sufficiently prevented.

As described in the above, by making the amounts of temperature rise per unit time of the layers as a single layer at the time of raising the temperature (the temperature rise per unit time in the case where each of the layers is separately irradiated by heat rays) to be such ones respectively as to become higher in the order of the ray-transmitting base member, the ray-transmitting elastic layer or the ray-transmitting heat insulating layer, and the ray absorbing layer for generating heat, the temperature drop in the ray absorbing layer and the hysteresis in the portion through which transfer materials pass during printing can be prevented, which makes the temperature of the rotary member for applying heat stabilized, and enables a shorter warm-up time.

Further, the heat ray absorption ratio per unit thickness in each of the layers is shown in FIG. 9, where α1(%) denotes the heat ray absorption ratio per unit thickness (mm) of the ray-transmitting base member 171*a,* α2(%) denotes the heat ray absorption ratio per unit thickness (mm) of the ray-transmitting elastic layer 171*d* (or the ray-transmitting heat insulating layer 171*e*), and α3(%) denotes the heat ray absorption ratio per unit thickness (mm) of the ray absorbing layer for generating heat 171*b* as a single layer. The ray-transmitting base member 171*a,* which is mainly made of a glass material, has a poor cylindricity, roundness, and an uneven thickness, to cause the unevenness of thickness often to occur in the ray-transmitting elastic layer 171*d* (or the ray-transmitting heat insulating layer 171*e*) provided on the outside (outer circumferential surface) of the ray-transmitting base member 171*a*. Therefore, the ray-transmitting base member 171*a* is placed in a mold, and a silicone rubber or fluorine-contained rubber material is injected into the clearance between the mold and the ray-transmitting base member 171*a,* to form the ray-transmitting elastic layer 171*d* on the outside (outer circumferential surface) of the ray-transmitting base member 171*a* by solidifying it. The ray fixing roller 17*a* is formed by coating the inner side wall of the mold beforehand with the ray absorbing layer for generating heat 171*b* or by applying it over the solidified ray-transmitting elastic layer 171*d*. The ray fixing roller 17*a* made by this method has its unevenness of the surface of the ray-transmitting base member 171*a* made even by the ray-transmitting elastic layer 171*d,* and obtains a high precision in the outer diameter as the whole (overall layer thickness), to make the fluctuation of thickness as the overall thickness fall within the range from 0.1 to 0.5 mm. The fluctuation of thickness of the ray-transmitting base member 171*a* and that of the ray-transmitting elastic layer 171*d* (or the ray-transmitting heat insulating layer 171*e*) are both suppressed to 1 mm or under. As described before in FIG. 4(*a*) and FIG. 4(*b*), for the cylindrical ray-transmitting base member 171*a,* the thickness is 1 to 4 mm, or desirably 1.5 to 3 mm, and the thickness of the ray-transmitting elastic layer 171*d* is 1 to 4 mm, or desirably 2 to 3 mm, that is, it is optimum that the thickness of the ray-transmitting base member 171*a* and the thickness of the ray-transmitting elastic layer 171*d* (or the ray-transmitting heat insulating layer 171*e*) is determined to be approximately equal; further, it makes the overall thickness of all the layers even, and as will be described later, makes even the absorption of heat rays in the inner portion of the ray fixing roller 17*a* to make a uniform heat generation, to make larger the thickness of the ray-transmitting elastic layer 171*d* (or the ray-transmitting heat insulating layer 171*e*) than the ray-transmitting base member 171*a,* to determine the ratio to the thickness of the ray-transmitting base member 171*a* to be 2 or under.

In the case where the fluctuation of the thickness of the ray-transmitting base member 171*a* of the ray fixing roller 17*a* manufactured by using the above-mentioned manufacturing method and the fluctuation of the thickness of the ray-transmitting elastic layer 171*d* (or the ray-transmitting heat insulating layer 171*e*) of the same are both 0.1 mm or over, it is desirable that the difference between the above-mentioned heat ray absorption ratio per unit thickness (mm) of the ray-transmitting base member 171*a* as a single layer $\alpha$1(%), and the heat ray absorption ratio per unit thickness (mm) of the ray-transmitting elastic layer 171*d* (or the ray-transmitting heat insulating layer 171*e*) as a single layer $\alpha$2(%) is determined to be within 20%.

That is, the inventors of the present invention have found that when the difference between the above-mentioned heat ray absorption ratio $\alpha$1(%) and $\alpha$2(%) exceeds 20%, the distribution of an amount of heat generation on the outer surface and in the inside of the ray fixing roller 17*a* has lack of uniformity, thereby uneven fixing is caused, however, when the difference is not more than 20%, the distribution of the amount of heat generation on the outer surface and in the inside of the ray fixing roller 17*a* becomes uniform, consequently even fixing can be realized.

The heat ray absorption ratio of 1 mm thickness (heat ray absorption ratio per unit thickness (mm)) of the ray-transmitting base member 171*a* as a single layer is about 15%, and the heat ray absorption ratio of 1 mm thickness (heat ray absorption ratio per unit thickness (mm)) of the ray-transmitting elastic layer 171*d* (or the ray-transmitting heat insulating layer 171*e*) as a single layer is about 20%, and the heat ray absorption ratio of each of the layers increases in accordance with the increase of the thickness; it is desirable that the thickness of the both layers are made equal to each other and the ray absorption ratios of the both over the whole thickness are made equal to each other; it is desirable that the fluctuation of the thickness of the ray-transmitting base member 171*a* and the fluctuation of the thickness of the ray-transmitting elastic layer 171*d* (or the ray-transmitting heat insulating layer 171*e*) are both made to be 0.1 mm to 1 mm, or desirably to 0.5 mm. Further, it is desirable that the thickness of the ray-transmitting elastic layer 171*d* (or the ray-transmitting heat insulating layer 171*e*) is larger than the ray-transmitting base member 171*a,* while the ratio of the thickness to that of the ray-transmitting base member 171*a* is determined to be within 2. In this way, the fixing performance is enhanced by making the thickness of the ray-transmitting elastic layer large. In addition, it has been found that since the ray-transmitting elastic layer fulfils function as a heat insulating layer, heat generated on the surface of the roller is not liable to escape toward the ray-transmitting base member, thereby the raising temperature or the applying heat can be easily carried out. On the other hand, if the thickness of the ray-transmitting elastic layer is thicker than necessary, the heat absorption of the ray-transmitting elastic layer becomes large (heat capacity is also increased), and the heat rays do not reach the surface. However, it has been found that this problem can be solved by making the thickness of the ray-transmitting elastic layer to be not more than twice the thickness of the ray-transmitting base member.

Further, the heat ray absorption ratio of 1 mm thickness (heat ray absorption ratio per unit thickness (mm)) of the ray-transmitting base member 171*a* as a single layer and that of the ray-transmitting elastic layer 171*d* (or the ray-transmitting heat insulating layer 171*e*) as a single layer are both determined to be 15 to 35%. In essence, the heat absorption of the ray-transmitting base member and the ray-transmitting elastic layer is desirable as small as possible in order to directly generate heat from the surface of the roller. However, if the heat ray absorption ratio is too small, the temperature only on the roller surface is raised to an extreme while keeping the inside of the roller cold. This causes the problem that the history of the sheet feeding remains because of the lowering of temperature and so on due to the sheet feeding. It has been found that the addition of the above-mentioned conditions and the presence of small amount of heat absorption ease the problem mentioned above and the effect of even fixing can be obtained.

Furthermore, as described in the above, it is desirable that the difference between the heat ray absorption ratio per unit thickness (mm) of the ray-transmitting base member 171*a* as a single layer $\alpha$1(%), and the heat ray absorption ratio per unit thickness (mm) of the ray-transmitting elastic layer 171*d* (or the ray-transmitting heat insulating layer 171*e*) as a single layer $\alpha$2(%) is determined to be within 20%. Moreover, in order to make the difference within the above-mentioned value, it is desirable that the adjustment of the heat ray absorption ratio is done by coloring the ray-transmitting base member 171*a* and the ray-transmitting elastic layer 171*d* with an additive etc.

Owing to the above-mentioned determination, the temperature distribution inside the ray fixing roller 17*a* as a rotary member for applying heat is made uniform, and the radiation quantity reaching the ray absorbing layer for generating heat 171*b* at the surface becomes uniform; therefore, the unevenness of the heat generation in the ray absorbing layer for generating heat 171*b* is small, and the temperature of the ray absorbing layer for generating heat 171*b* is stable and uniform.

In addition, in the above description, each heat ray absorption ratio depends on the radiation source because the radiation sources (a halogen lamp, a xenon lamp, etc.) have different spectral characteristics from one another. Further, the above-mentioned heat ray absorption ratio is an absorption ratio for the effective radiation energy including the spectral characteristics. Further, as a simplified method of obtaining it, it is possible to obtain an effective heat ray absorption ratio from the rate of temperature rise in each of the layers shown in FIG. 8.

According to the above description, it is prevented, the unevenness of heat generation in the ray-transmitting base member, ray-transmitting elastic layer or the ray-transmitting heat insulating layer, and the ray absorbing layer for generating heat, which are provided inside the rotary member for applying heat, and it is accomplished to make even the temperature distribution inside the rotary member for applying heat, while the radiation quantity reaching the ray absorbing layer at the surface is also made uniform; therefore, the unevenness of heat generation in the ray absorbing layer for generating heat at the surface is prevented, which makes it possible to provide a fixing apparatus capable of making a quick start (rapid heating) with the temperature of the ray absorbing layer for generating heat made stable and uniform.

According to this invention, it is prevented, the unevenness of heat generation in the ray-transmitting base member, ray-transmitting elastic layer or the ray-transmitting heat insulating layer, and the ray absorbing layer for generating heat, which are provided inside the rotary member for applying heat, and it is accomplished to make even the temperature distribution inside the rotary member for applying heat with respect to the direction along the circumferential surface, while the radiation quantity reaching the ray absorbing layer at the surface is also made uniform; therefore, the unevenness of heat generation in the ray absorbing layer for generating heat at the surface is prevented, which makes it possible to provide a fixing apparatus capable of making a quick start (rapid heating) with the temperature of the ray absorbing layer for generating heat made stable and uniform.

What is claimed is:

1. A fixing apparatus for fixing a toner image on a transfer material by applying heat and pressure onto the transfer material by a roll-shaped rotary member for applying heat, the roll-shaped rotary member comprising:

(a) a ray radiating device for radiating heat rays;

(b) a cylindrical ray-transmitting base member having transmittance for the heat rays, and having the ray radiating device inside thereof; and (c) a cylindrical ray-transmitting elastic layer or ray-transmitting heat insulating layer having transmittance for the heat rays, wherein the roll-shaped rotary member has a heat ray absorbing layer provided outside the ray-transmitting elastic layer or the ray-transmitting heat insulating layer for absorbing the heat rays, wherein a difference between a heat ray absorbing ratio (%) per unit thickness (mm) in the ray-transmitting base member and that in either the ray-transmitting elastic layer or the ray-transmitting heat insulating layer is made not more than 20%, and wherein a fluctuation of thickness of the ray-transmitting base member and a fluctuation of thickness of either the ray-transmitting elastic layer or the ray-transmitting heat insulating layer are not less than 0.1 mm.

2. The fixing apparatus of claim 1, wherein a fluctuation of thickness of the ray-transmitting base member and a fluctuation of thickness of either the ray-transmitting elastic layer or the ray-transmitting heat insulating layer are both not more than 1 mm.

3. The fixing apparatus of claim 1, wherein the thickness of the ray-transmitting elastic layer or the ray-transmitting heat insulating layer is larger than that of the ray-transmitting base member, while the ratio of the thickness of the ray-transmitting elastic layer to that of the ray-transmitting base member is within 2.

4. The fixing apparatus of claim 1, wherein the heat ray absorbing ratio (%) of the ray-transmitting base member and that of either the ray-transmitting elastic layer or the ray-transmitting heat insulating layer are both within the range of 15 to 35%.

* * * * *